United States Patent [19]

Brown

[11] 4,158,455

[45] Jun. 19, 1979

[54] WALL PANEL INSTALLATION JIG

[76] Inventor: Spencer Brown, 80 Walnut Ave., N. Amityville, N.Y. 11701

[21] Appl. No.: 874,389

[22] Filed: Feb. 2, 1978

[51] Int. Cl.[2] ..... B23Q 3/02

[52] U.S. Cl. ..... 269/102; 269/321 S

[58] Field of Search ..... 269/102, 321 S, 289 R, 269/285; 145/1 A; 33/187–188

[56] References Cited

U.S. PATENT DOCUMENTS

| | | | |
|---|---|---|---|
| 980,924 | 1/1911 | De Bord | 269/102 |
| 1,063,292 | 6/1913 | Schilders et al. | 269/102 |
| 3,904,184 | 9/1975 | Krueger | 269/102 |

*Primary Examiner*—Robert C. Watson

*Attorney, Agent, or Firm*—Natter & Natter

[57] ABSTRACT

A jig for holding planar sheet material during installation. The device includes a channel section provided with captively held nail members for temporarily attaching the jig to a substructure, e.g. wall studs. The channel section further has a groove along an interior wall surface for receiving an interchangeable frictional holding strip. The intersection of a second interior wall and bottom surface forms an inclined wedging surface. An edge of the sheet material is placed within the channel and is grippingly engaged by the coaction of the frictional holding strip and the wedging surface. The sheet material is angularly supported resting against the substructure and can then be nailed in place.

11 Claims, 8 Drawing Figures

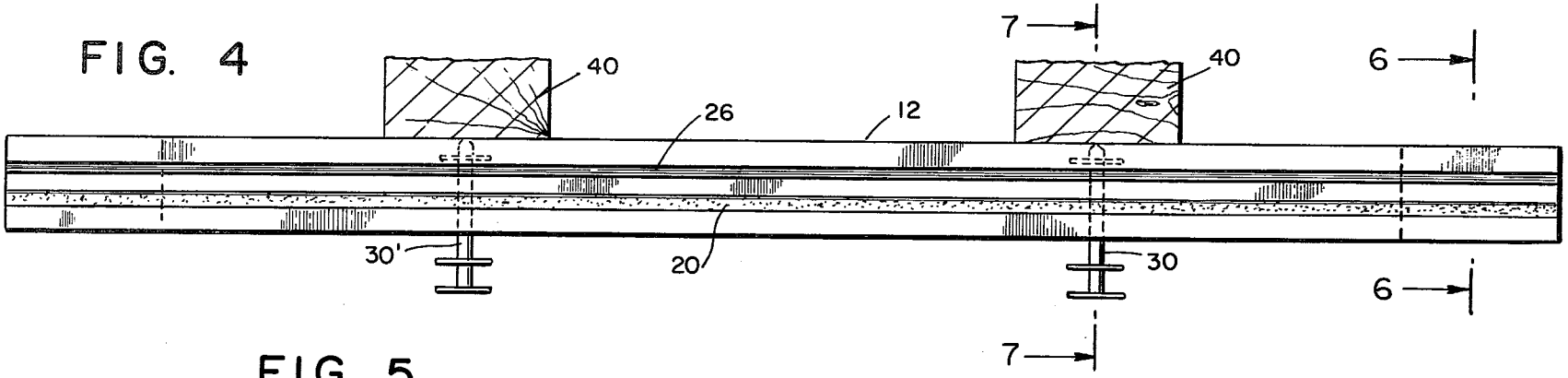
FIG. 4
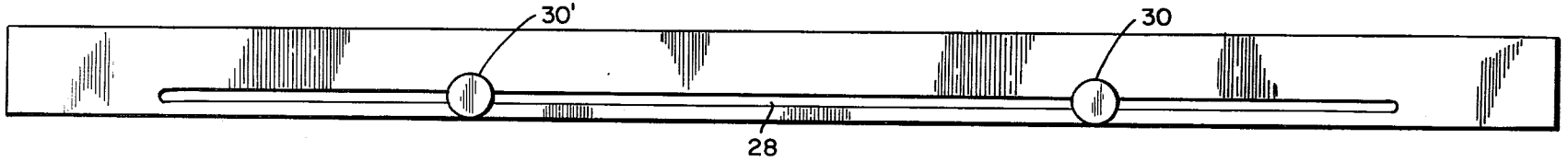
FIG. 5
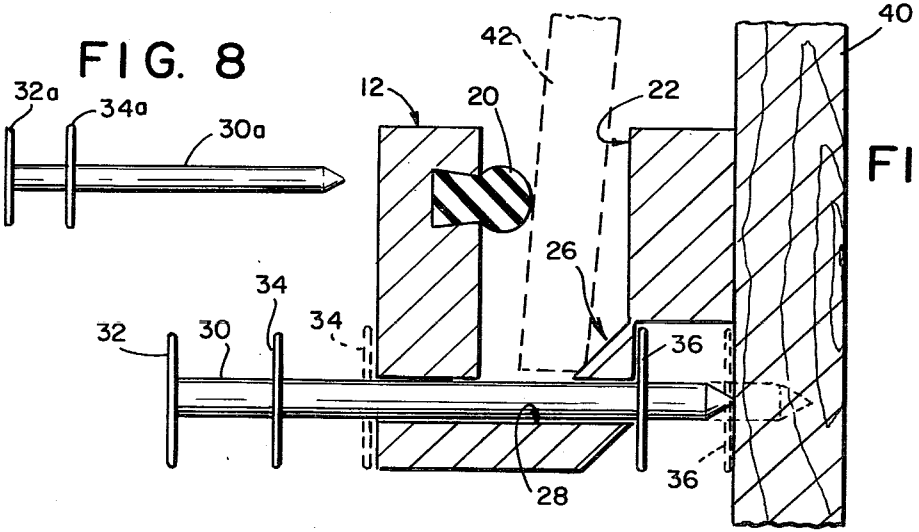
FIG. 7
FIG. 8
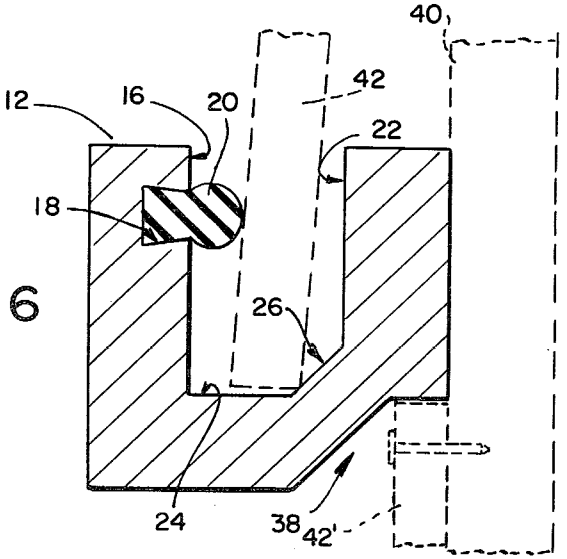
FIG. 6

WALL PANEL INSTALLATION JIG

BACKGROUND OF THE INVENTION

1. Field of the Invention

This invention pertains to support devices and especially to a bracket for providing temporary support during building construction.

In particular, the device of this invention concerns a wall panel installation jig for holding sheetlike material during installation to walls and ceilings.

2. Description of the Prior Art

The erection of interior walls, partitions, ceilings and similar surfaces usually involves the installation of large panels which are nailed or otherwise fastened to studs, ceiling joists and similar support members. The panels used for these types of assemblies are typically made of sheetrock, gypsam, plywood, cemento board and like materials, and are usually sold in panel sections 4 to 6 feet (1.2 to 1.8 meters) in width and 6 to 10 feet (1.8 to 3 meters) in height. In order to install these rather large panels, two men are usually required, with one man holding the panel in place while the other man nails the panel. This procedure involving a minimum two man work crew is a substantial factor in estimating the costs. Furthermore, many homeowners and do-it-yourselfers frequently attempt to perform modernization or alteration work and additional help may not be available when installing such panels.

The present invention provides a simplified procedure for the installation of these panels and overcomes many of the problems involved in the prior art.

Various support devices are known for aiding in the placement of wall panels. Many of these devices, however, are rather cumbersome and difficult to handle and they do not encompass the temporary attachment of the device to a stud or support. One such device is shown in U.S. Pat. No. 3,524,239 and uses cooperating pairs of tools. Another device shown in U.S. Pat. No. 3,092,900 is attached to a support surface but in a plane perpendicular to the plane in which the panel is to be fixed. Using this procedure is would be difficult, if not impossible, to register adjacently placed coplanar panels. Furthermore, there is no provision for adjustably receiving panels of different thicknesses as in the present invention. Moreover, the prior art does not disclose a structure wherein the edge of the panel is firmly held in place during installation. In addition, the work jig of this invention permits a butt joint between coincident panels. It should therefore be apparent that the present invention overcomes many of the shortcomings of the prior art devices.

SUMMARY OF THE INVENTION

The wall panel installation jig of this invention provides a vehicle for temporarily holding wall panels and other sheet materials during installation. The device includes a channel section having fasteners for temporary attachment to a substructure surface. The channel section includes a longitudinal groove within an interior wall. A frictional holding strip is releasably retained within the groove. An opposite interior wall and bottom surface of the channel section define an inclined or wedging surface. The action of the wedging surface upon the wall panel urges the panel toward the holding strip which frictionally engages the edge of the panel to provide a firm grip. The panel is angularly supported in a rest position leaning against the substructure. The holding strip is further removable from within the groove for replacement by other strips of different material and/or dimensional specifications which can be selected in accordance with the particular panel composition and thickness.

In a preferred embodiment, fastening is provided by a nail member. The nail member is passed through a slot and is slidingly displaceable for alignment in registration with stud spacing or other support elements. One end of the nail member is provided with a driving head and spaced therefrom is a secondary penetration head. This arrangement permits the nail member to be readily extracted from the channel section. In one embodiment, the nail member is further provided with a retainer head which prevents complete removal of the nail member from the channel section so that it will be captively retained within the slotted opening. In an auxiliary embodiment, the retainer head is omitted for use in a particular application wherein an upper wall panel is to be placed in abutment with a previously installed lower wall panel.

Another feature of this invention which is noted in conjunction with the last mentioned application is that the channel section is provided with a notched opening so as to permit the abutting installation of adjacent wall panels.

Having thus summarized the invention, it will be seen that an object thereof is to provide a wall panel installation jig of the general character described herein.

Specifically, it is an object of the present invention to provide an installation jig for furnishing a temporary support during installation of sheetlike material.

A further object of this invention is to provide an installation jig having a channel section for grippingly engaging and firmly holding an edge of a panel to be installed.

An additional object of the present invention is to provide an installation jig having captively retained nail fastener members.

A still further object of this invention is to provide an installation jig including a notched opening to permit abutting contact between adjacently placed panel members.

The above and other objects, features and advantages of this invention will be apparent from the following description of the preferred embodiment when considered in connection with the accompanying drawings.

BRIEF DESCRIPTION OF THE DRAWINGS

In the accompanying drawings in which are shown preferred embodiments of the invention:

FIG. 4 is a plan view of the panel jig and shows two captive nail members and a frictional holding strip;

FIG. 5 is a front elevational view of the panel jig shown in FIG. 4 and shows the nail members slidably mounted in a slotted opening for alignment in registration with the stud spacing;

FIG. 6 is a sectional view to a slightly enlarged scale taken substantially along line 6—6 of FIG. 4 and further shows the channel section affixed to a stud; in this instance a previously installed lower panel is positioned within a notched area of the channel section to permit abutting alignment with the upper wall panel to be installed;

FIG. 7 is a sectional view to a slightly enlarged scale taken substantially along line 7—7 of FIG. 4 and shows the channel section and the displacement of the captive nail member as indicated by the broken line; and FIG. 8 is a sectional view of another embodiment of a nail member to a slightly reduced scale for use with the channel section when an upper wall panel is to be placed in abutment with a lower previously installed wall panel.

DESCRIPTION OF THE PREFERRED EMBODIMENTS

Figure 2:
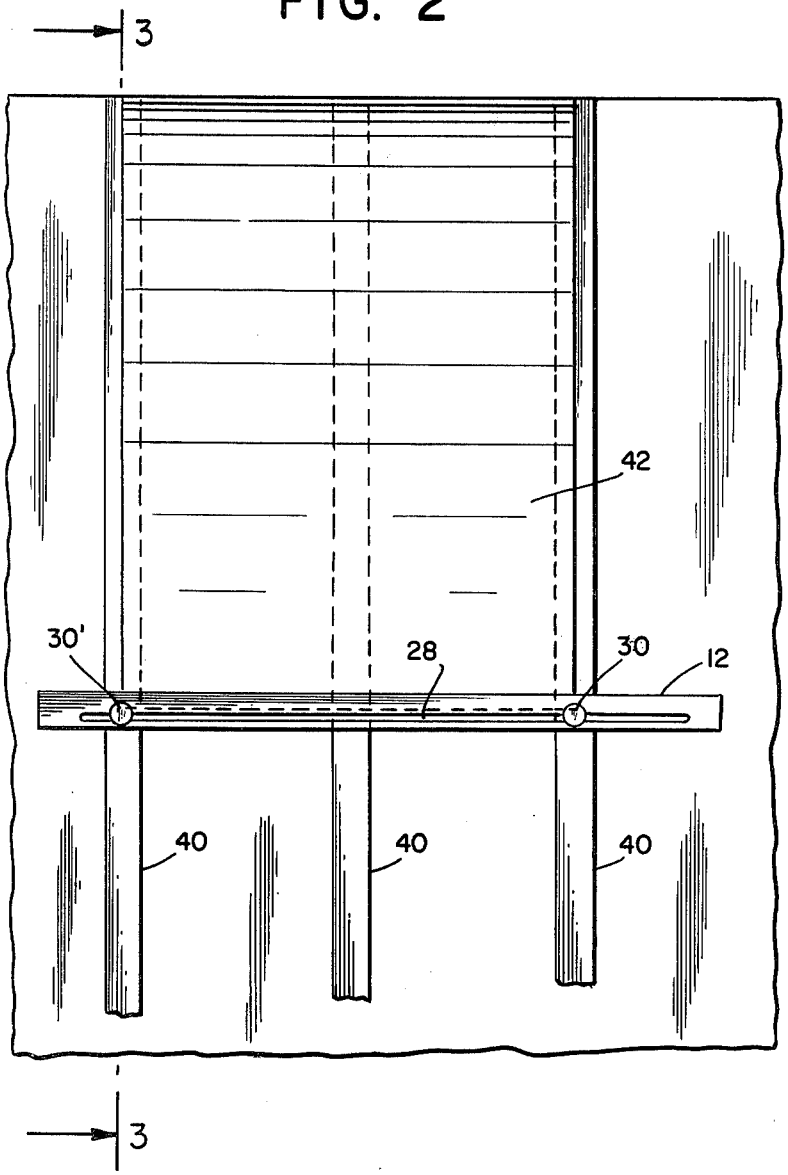
FIG. 2 is an elevational view of the invention to a reduced scale and illustrates the installation jig in use in this instance it has been attached to two wall studs and is supporting a wall panel to be secured to the studs.

Referring now in detail to the drawings, the reference numeral 10 denotes generally a preferred embodiment of a wall panel installation jig of this invention.

The invention will be described in conjunction with a typical use for the installation of vertical sheetrock material such as is used for wall assemblies. It should, however, be understood that this device can be suitably adapted for multiple uses including erection of horizontal ceiling panels and is adaptable for holding a wide range of materials of varying thicknesses.

The jig 10 is comprised of a channel section 12 having a work receiving opening 14. An interior wall 16 of the channel section 12 is provided with a longitudinal groove 18 which is adapted to receive a frictional holding strip 20. The intersection of an opposite interior wall 22 and a bottom surface 24 includes an inclined or wedging surface 26 which forms an angle of approximately 45° with the bottom interior surface 24.

The channel section 12 is preferably fabricated from extruded aluminum alloy or like material being relatively light in weight. The frictional holding strip 20 can be fabricated of a flexible rubber, plastic or similar material for providing a yieldable contact surface. The channel section 12 typically has a length of approximately 4 feet (1.2 meters). The frictional holding strip 20 is removably seated within groove 18 for replacement by other holding strips of different materials and/or dimensional specifications as may be required in accordance with the particular workpiece composition and/or thickness. The channel section 12 is further provided with a slotted opening 28 passing transversely therethrough. A nail member 30 is positioned within the slotted opening 28 and is oriented in a manner shown in FIG. 7. The nail member 28 is provided at one end with a driving head 32 and spaced therefrom is a secondary penetration head 34. Both the driving head 32 and the penetration head 34 are positioned at a front face of the channel section 12 and exteriorly of the slotted opening 28. The opposite end of the nail member 30 is provided with a retainer head 36 which is positioned at the rear face of the channel section 12 and exteriorly of the slotted opening 28.

In assembling the jig 10, the nail member 30 can be placed through an enlargement in the slotted opening 28 (not shown) to permit passage of the retainer head 36, and thereafter this enlargement can be plugged. An alternate means of assembly can be effected by placing the retainer head 36 upon the nail member 30 after insertion through slotted openings 28. The head 36 can be in the form of a washer which can be locked within a receiving groove formed in nail member 30.

An alternate embodiment of a nail member **30*a* is shown in FIG. 8. In this embodiment the retainer head 36 has been omitted, however a driving head 32*a* and a penetration head 34*a* remain. The use of this auxiliary nail member 30*a* remain. The use of this auxiliary nail member 30*a* will be further described in conjunction with the operation of this invention. In addition, it should also be noted that the channel section 12 has a notched exterior corner 38 in which a portion of the channel section 12 has been removed. The upper margin of this notched corner 38 is substantially coplanar with the bottom interior surface 24. The purpose for this notched corner 38** will become apparent hereinafter.

Figure 3:
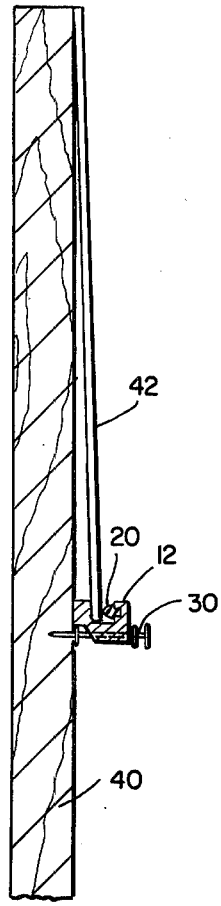
FIG. 3 is a sectional view taken along 3—3 of FIG. 2 and shows the installation jig affixed to a stud with a wall panel being grippingly engaged and angularly supported by the channel section.
Figure 1:
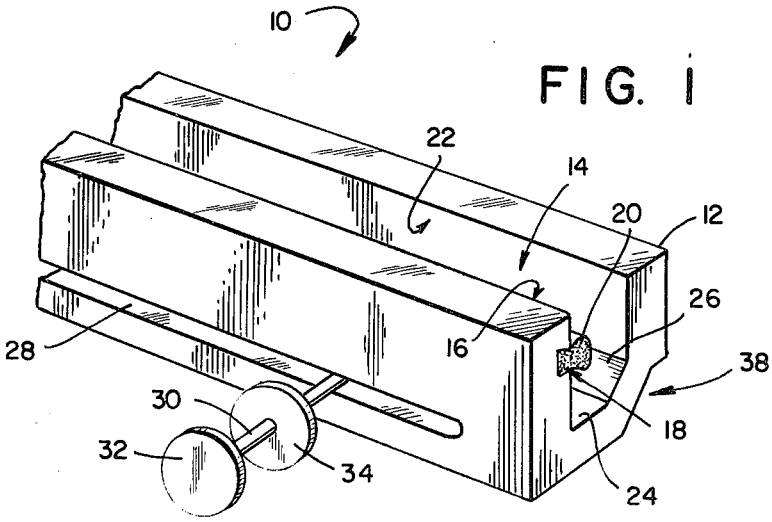
FIG. 1 is a perspective view of a portion of a wall panel installation jig of this invention and shows a channel section having a frictional holding strip and a wedging surface.

In operation, the channel section 12 is initially fastened to a substructure surface, in this typical instance being vertical wall studs 40 as shown in FIGS. 2 and 3 with the work receiving opening 14 substantially parallel to the plane of the substructure. Two nail members 30, 30' are slidably displaced within the slotted opening 28 until they are aligned in registration with the wall studs 40. Impact blows upon driving head 32 cause penetration of the nail member 30, 30' into the studs 40 and will displace the penetration head 34 into contact with the front face of channel section 12. As previously noted, the retainer head 36 captively holds the nail member 30 and thereby the operator will have one hand free for supporting the channel section 12 while performing this nailing operation. The notched corner 38 permits free movement of the retainer head 36 toward the stud 40. The distance between the driving head 32 and the penetration head 34 is equal to the spacing of the retainer head 36 from the penetration end of the nail member 30 so that the retainer head 36 will contact the face of stud 40 simultaneously with the contact of penetration head 34 upon the face of channel section 12. Thus, the penetration head 34 will serve as a limit stop as well as providing leverage space for extracting the nail member 30 after the installation has been completed. In FIG. 7 the broken line portion of the illustration indicates the positioning of the respective penetration head 34 and retainer head 36 subsequent to the nail member 30 having penetrated the stud 40. After the channel section 12 has been fastened to the studs 40, a wall panel 42 can then be placed within work receiving opening 14. The weight of the panel 42 resting upon the wedging surface 26 will urge or slide panel 42 into contact with the flexible holding strip 20 (see FIGS. 6 and 7). The panel 42 will be tilted obliquely such that the upper end will rest against the stud 40. The panel 42 as thus held is now ready for securement to the studs 40 and can be nailed starting from the top in a conventional manner and by one man. Prior to completion of the nailing operation and after the wall panel 42 has been secured to the wall studs 40, the jig 10 can be removed and the nailing of the wall panel 42 completed. The same procedure is followed for each of the panels to be installed.

In the event it is desirable to install, for instance, wall panels beginning with a lower section and moving upward, use of auxiliary nail member **30*a* is desirable. FIG. 6 demonstrates how the notched corner 38 accommodates the edge of a lower panel 42' previously installed. The upper panel 42, after installation, will be in abutting contact with the lower panel 42'. The nail member 30***a* is substituted in place of nail member 30 which can be left within the channel section 28 and merely slid to an end of slotted opening 28 so as to clear the previously installed section 42'.

From the above description it should be apparent that one man could thus install wall panelling or similar sheet material with the aid of the panel jig of this invention. Other possible embodiments of the present invention and various changes may be incorporated by those skilled in the art without departing from the spirit of this invention. It should therefore be understood that the invention is not limited to what is described in the specification and drawings which should not be interpreted in a limiting sense.

Having thus described the invention there is claimed as new and desired to be secured by Letters Patent:

1. A wall panel installation jig comprising a channel section having a continuous opening for receiving an edge of the wall panel, fastening means for temporarily securing the channel section to a substructure, said channel section opening further including cooperative wedging and friction means for grippingly engaging the wall panel edge and angularly supporting the wall panel for attachment to the substructure.

2. A wall panel installation jig as claimed in claim 1 wherein the friction means includes a holding strip, said holding strip being removably secured to an interior wall of the channel section.

3. A wall panel installation jig as claimed in claim 2 wherein the wedging means includes an inclined surface within the channel section for urging the edge of the wall panel toward the holding strip.

4. A wall panel installation jig as claimed in claim 3 wherein the channel section is provided with retainer means for securing the holding strip, said retainer means being adapted for interchangeably accommodating selective holding strips compatible with particular wall panels.

5. A wall panel installation jig as claimed in claim 1 wherein the fastening means includes a slotted opening extending transversely through the channel section and nail means mounted within the slotted opening for penetration into the substructure to secure the channel section with the channel opening lying in a plane substantially parallel to the plane of the substructure.

6. A wall panel installation jig as claimed in claim 5 wherein the nail means includes at least two heads for limiting penetration into the substructure and for facilitating extraction thereof to release the channel section.

7. A wall panel installation jig as claimed in claim 6 wherein the nail means includes an impact head for driving the nail, a secondary head spaced therefrom for limiting penetration into the substructure and a retainer head for captively securing the nail within the slotted opening.

8. A wall panel installation jig as claimed in claim 7 wherein the impact and penetration heads are each located on one side of the slotted opening and the retainer head is located on the other side of said slotted opening.

9. A wall panel installation jig as claimed in claim 1 wherein said channel section is provided with a notched exterior corner for accommodating the edge of a previously installed wall panel, the upper margin of said notched corner defining a plane being substantially coincident with a plane defined by a bottom interior surface of the channel section whereby the lower edge of a wall panel supported within the channel section will be in abutting contact with the previous wall panel after installation.

10. A wall panel installation jig as claimed in claim 9 further including auxiliary nail means having an impact head and a penetration head for securing the channel section over the previously installed wall panel.

11. A jig for holding planar sheet material during installation comprising a channel section having a continuous longitudinal opening for receiving an edge of the sheet material, a slotted opening extending transversely through the channel section, nail means captively retained within the slotted opening and being selectively positionable for temporarily securing the channel section to a substructure with the longitudinal opening extending substantially parallel to the plane of the substructure, whereby the sheet material can be supported for attachment to the substructure.

* * * * *